US007104751B2

(12) United States Patent
Naik et al.

(10) Patent No.: US 7,104,751 B2
(45) Date of Patent: Sep. 12, 2006

(54) HOT GAS PATH ASSEMBLY

(75) Inventors: Shailendra Naik, Gebenstorf (CH); Ulrich Rathmann, Baden (CH)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 10/865,749

(22) Filed: Jun. 14, 2004

(65) Prior Publication Data

US 2004/0258517 A1 Dec. 23, 2004

Related U.S. Application Data

(63) Continuation of application No. PCT/CH02/00686, filed on Dec. 12, 2002.

(30) Foreign Application Priority Data

Dec. 13, 2001 (CH) ..... 2279/01

(51) Int. Cl.
*F01D 11/12* (2006.01)
*F01D 11/10* (2006.01)

(52) U.S. Cl. ..... 415/116; 415/173.5; 415/180

(58) Field of Classification Search ..... 415/116, 415/115, 180, 173.1, 173.4, 173.5
See application file for complete search history.

(56) References Cited

U.S. PATENT DOCUMENTS

| | | | | |
|---|---|---|---|---|
| 3,365,172 A | | 1/1968 | McDonough et al. | 253/39.15 |
| 3,728,039 A | | 4/1973 | Plemmons et al. | 415/115 |
| 3,825,364 A | | 7/1974 | Halila et al. | 415/116 |
| 3,970,319 A | | 7/1976 | Carroll et al. | 277/53 |
| 3,975,901 A | * | 8/1976 | Hallinger et al. | 60/786 |
| 4,013,376 A | | 3/1977 | Bisson et al. | 415/117 |
| 4,311,431 A | | 1/1982 | Barbeau | 415/172 A |
| 4,497,610 A | | 2/1985 | Richardson et al. | 415/116 |
| 4,522,557 A | | 6/1985 | Bouiller et al. | 415/115 |
| 5,161,944 A | * | 11/1992 | Wood | 415/173.3 |
| 5,993,150 A | * | 11/1999 | Liotta et al. | 415/115 |
| 6,126,390 A | * | 10/2000 | Bock | 415/115 |
| 6,171,052 B1 | | 1/2001 | Aschenbruck et al. | 415/173.1 |
| 6,612,806 B1 | * | 9/2003 | Bolms et al. | 415/115 |

FOREIGN PATENT DOCUMENTS

| | | |
|---|---|---|
| EP | 0 957 237 A2 | 11/1999 |
| EP | 1 124 039 A1 | 8/2001 |
| EP | 1 162 346 A2 | 12/2001 |
| JP | 61-149506 | 7/1986 |

* cited by examiner

*Primary Examiner*—Edward K. Look
*Assistant Examiner*—Nathan Wiehe
(74) *Attorney, Agent, or Firm*—Steptoe & Johnson LLP

(57) ABSTRACT

A hot gas path assembly, suitable for use in the hot gas path of a gas turbine, has as a hot gas duct wall an impact-cooled gas-impermeable element and a transpiration-cooled gas permeable element. The gas-permeable element is a run-on covering for the sealing tip, and the gas-impermeable element is a blade foot of a turbine blade. Coolant is led in series through an impact-cooling element to cool the gas-impermeable element, and through the gas-permeable element for transpiration cooling and, if appropriate, also cools the sealing tip. Coolant thus is utilized particularly efficiently. Subdividing walls are arranged for the lateral subdivision of the coolant path, particularly in the circumferential direction, into segments. Because of the subdivision, in the event of damage to the gas-permeable element in one segment, the other segments remain essentially uninfluenced. Redundant cooling orifices may ensure coolant flow even when flow resistance in a transpiration-cooled element rises.

20 Claims, 4 Drawing Sheets

HOT GAS PATH ASSEMBLY

CROSS-REFERENCE TO RELATED APPLICATIONS

This application is a continuation of the U.S. National Stage designation of co-pending International Patent Application PCT/CH02/00686 filed Dec. 12, 2002, the entire content of which is expressly incorporated herein by reference thereto.

FIELD OF THE INVENTION

The present invention relates to a hot gas path assembly for a turbomachine, in particular for a gas turbine. It relates, furthermore, to a turbomachine in which an assembly according to the invention is used.

BACKGROUND OF THE INVENTION

The efficiency of an axial-throughflow gas turbine is influenced, inter alia, by leakage streams of the compressed gas that occur between rotating and nonrotating components of the turbine. The gap occurring between the tips of the moving blades and the casing walls surrounding the moving blades plays an appreciable part in this. Efforts are therefore aimed at keeping the gaps as small as possible. In the event of deviation from the design point, a brushing of the moved components against the static components can easily occur. For this reason, use is often made of brushing- and/or abrasion-tolerant structural elements, such as, for example, honeycomb seals, honeycombs or else porous ceramic or metallic structures or felts, which serve as counterrunning surfaces of the sealing tips of the moving blades and are partially cut into by these during a running-in phase. Use of such brushing-tolerant sealing elements reduces serious machine damage in the event of minor brushing events, since the brushing is absorbed by the soft structure of the counterrunning surface, without the blades being damaged.

Both the tips of the moving blades or guide vanes and the honeycomb seals used are exposed to very high temperatures when the gas turbine is operating in the hot-gas mode.

It is therefore known, for example from U.S. Pat. No. 3,365,172, to act upon the sealing tips of the moving blades through honeycomb seals with cooling air. For this purpose, the carrier for the honeycomb seals is pierced through with small cooling air bores that are supplied with cooling air via a peripheral annular chamber.

JP 61149506 shows a similar embodiment, in which the honeycomb seals are carried by a layer of porous metal that is contiguous to a supply chamber for cooling air. In this embodiment, too, the cooling air is delivered to the blade tips through the honeycomb seals.

The routing of cooling air through porous sealing elements is likewise known from U.S. Pat. No. 6,171,052. In this case, the porous sealing elements are transpiration-cooled by the cooling air when the latter flows through them. U.S. Pat. No. 4,013,376 discloses a configuration in which the counterrunning surface of the blades is designed to be both impact-cooled and transpiration-cooled. U.S. Pat. No. 3,728,039 likewise discloses transpiration-cooled porous rings as counterrunning surfaces of blades. In this case, the feed of cooling air to the ring is segmented. The ring itself is produced in one piece.

One problem with a multiplicity of configurations is that, when, due to brushing, damage to the gas-permeable elements occurs or even a region is torn out completely, the coolant pressure collapses, and overheating and finally the failure of the entire sealing arrangement occur. Likewise, when, in a region, the porosity is blocked due to deformation induced by brushing or else due to dirt, the coolant flows around this region of the sealing element. The cooling of the latter is no longer ensured, and local overheating occurs. Due to the overheating, the region affected may burn up. The cooling air then flows out through the large hole which has thus arisen, and the previously unaffected regions are no longer cooled. The component as a whole consequently fails over the entire circumference.

A further challenge that arises is to use the available cooling air as efficiently as possible, since, by virtue of a saving of cooling air, considerable power output and efficiency potentials can be exploited.

SUMMARY OF THE INVENTION

The present invention relates to a hot gas path assembly of the type initially mentioned, that avoids the disadvantages of the prior art. In particular, the hot gas path assembly is to be designed in such a way that the cooling air is utilized as efficiency as possible and that, in the event of damage to a region of the sealing element, the cooling of the regions not directly affected remains essentially unimpaired. In other words, potentially occurring damage is to remain restricted as far as possible to the location of the primary damage-triggering event.

The core of the invention is, therefore, on the one hand, to connect two cooling points in series in a cooling air path, in such a way that the flowing cooling air is utilized in succession in order to perform two cooling tasks. In one embodiment of the invention, by means of the same cooling airstream, the stator of a gas turbine is cooled both in the region of a guide vane row and in the region of a moving blade row, and, at the same time, the moving blade tips or the moving blade cover band are acted upon by the same cooling air. In this way, the maximum permissible cooling air heating is achieved, and the cooling potential of the cooling air is utilized to the maximum. On the other hand, the subdividing wall is designed in such a way that the cooling air flow paths of individual segments arranged next to one another in the circumferential direction of the machine are hermetically separated from one another downstream of an impact-cooling element. An impact-cooling element is provided with a multiplicity of comparatively small orifices, via which a cooling airstream is guided at high velocity onto the cooling side of the component to be cooled. Impact-cooling plates are often used. By virtue of this function, the impact-cooling elements cause a comparatively high pressure loss, and the essential throttle point, which also essentially brings about the metering of the coolant flowing through, is located in the respective coolant path. With an appropriate division of the pressure drops, the pressure loss coefficient of the impact-cooling element being greater, preferably by at least a factor of 2, than the pressure loss coefficient of the flow cross-sections arranged downstream of said impact-cooling element, the overall throughflow is determined in a first approximation solely by the impact-cooling element. From the configuration according to the invention, this means that, when, in a segment, damage to the gas-permeable element, in particular a sealing element, occurs, the flow conditions of the coolant are not changed dramatically, and the segments not primarily affected by the damage event are still supplied sufficiently with cooling air.

In a preferred embodiment of the invention, a plurality of gas-permeable elements are arranged next to one another in the circumferential direction. The multipiece, laterally, in particular circumferentially, segmented design of the sealing ring ensures, furthermore, that a local damage event also remains restricted mechanically to the segment directly affected. This is fulfilled all the more when individual sealing ring segments are arranged and fastened in such a way that as substantial a mutual mechanical decoupling as possible is achieved. Preferably, at least one individual gas-permeable element is arranged in each segment. As has already been set forth, the assembly according to the invention is very particularly appropriate when the gas-permeable element is an integral part of a contactless seal of a turbine machine, in particular between a guide vane and the rotor and, very particularly, between a moving blade and the stator.

In one embodiment of the invention, the gas-impermeable element is arranged upstream of the gas-permeable element in the direction of the hot gas flow. In this case, it is advantageous if the gas-impermeable element has a further redundant coolant orifice that issues on the hot gas side of the assembly. Preferably, the coolant orifice issues upstream of the gas-permeable element, as near as possible to the gas-permeable element. In this case, the coolant orifice is as far as possible designed in such a way that coolant emerging there flows as parallel as possible to the hot gas side surface of the gas-permeable element, in such a way that a cooling film arises there. This has the following major advantages: when the flow cross-sections of the gas-permeable element of the respective segment no longer allow an unimpeded throughflow due to the contamination or deformation, on the one hand, a coolant flow for the impact-cooling bores or impact cooling nozzles of the impact-cooling element continues to be ensured, and the cooling of the gas-impermeable element is ensured. At the same time, the air flowing out of the coolant orifice is laid as cooling film over the gas-permeable element and thus ensures a minimum cooling of this element, even though, because of the reduced throughflow, the transpiration-cooling effect of the air flowing through the element is diminished or is canceled completely. It is advantageous, in this case, if the flow cross-section of the gas-permeable element and of the coolant orifices are dimensioned, in design terms, such that the pressure loss of the coolant orifice is greater than that of the gas-permeable element in such a way that, in design terms, preferably less than 50% and, in particular, less than 30% of the overall coolant flows through the coolant orifice, and the remainder is conducted as transpiration coolant through the gas-permeable element. When the pressure loss of the latter increases on account of the effects described above, the coolant is displaced into the coolant orifice and the proportion of film cooling increases. As set forth above, in this case, the overall coolant mass flow remains constant in the first approximation when the pressure loss across the impact-cooling bores predominates.

As already indicated, the assembly according to the invention is suitable very particularly for use in turbomachines, the gas-permeable elements forming a peripheral ring for contactless sealing relative to an opposite blade ring. Preferably, the gas-impermeable elements also form a peripheral ring; this ring is preferably arranged upstream of the ring of gas-permeable elements in the direction of the hot gas throughflow of the turbomachine. In a preferred embodiment, the gas-impermeable elements are impact-cooled heat accumulation segments. In a further preferred embodiment, the impact-cooled gas-impermeable elements carry turbine blades, in particular guide vanes. Then in particular, the assembly according to the invention is arranged in the stator of the turbomachine.

In a preferred embodiment, above all when the assembly is an integral part of the turbomachine, the separating webs or subdividing walls for subdividing the segments run parallel to the profile chords of blades arranged in the flow duct and, in particular, on the gas-impermeable elements.

In one embodiment, the assembly consists of a number of subassemblies that are arranged laterally, in particular circumferentially, next to one another and which are constructed in such a way that each subassembly comprises gas-impermeable element and a gas-permeable element. Essentially, then, an impact-cooling element is arranged, spaced apart, on the hot gas side of the subassembly, opposite the gas-impermeable element, and a cover element is arranged opposite the gas-permeable element. Between the cover element and the impact-cooling element, on the one hand, and the gas-permeable and gas-impermeable element, on the other hand, is formed a space in the form of a ring segment or a gap essentially in the form of a ring segment, for the coolant. According to the invention, a subassembly of this type comprises at least one subdividing wall for the fluid-separating subdivision and/or delimitation of the annular gap in the lateral direction, in particular in the circumferential direction. In one embodiment, the subassembly carries at least one turbine blade; the subdividing wall then runs preferably parallel to the profile chord of this blade.

Preferably, an annular assembly should be subdivided in a circumferential direction into at least four segments capable of being acted upon by coolant independent of one another. By a relatively large number of segments being formed, the reliability of the cooling in the event of damage to the individual portions of the gas-permeable elements is increased.

Gas permeable and in this case, in particular, brushing-tolerant elements that may be considered are, in addition to honeycomb structures, honeycombs, inter alia, porous structures produced for example by foaming and consisting of metallic or ceramic materials or felts or fabrics consisting of metallic or ceramic fibers.

In an advantageous embodiment of the present device, furthermore, means for acting upon at least some of the segments by coolant independent of one another are provided. This may be implemented by means of a device that controls the supply of cooling medium to the individual segments via respective supply ducts independent of one another. In this way, an inhomogeneous temperature distribution can be compensated over the circumference of the flow duct during the operation of the turbomachine, in that individual segments are supplied with correspondingly adapted quantities of cooling medium. This is suitable, furthermore, for implementing a regulation of the gap width.

Even when the following exemplary embodiments assume an annular design or a design in the form of a ring segment of the assembly, in particular in a turbomachine, and very particularly in a gas turbine, the person skilled in the art readily recognizes that the invention also can be applied, for example, to plane geometries, in which case the segments then are not arranged next to one another in the circumferential direction, but laterally.

BRIEF DESCRIPTION OF THE DRAWINGS

The present cooling and sealing arrangement is explained below by means of exemplary embodiments in conjunction with the figures but which, in detail.

Elements not necessary for understanding the invention have been omitted. The exemplary embodiments are to be understood instructively and are to serve for a better understanding, but not a restriction of the invention characterized in the claims.

DETAILED DESCRIPTION OF THE PREFERRED EMBODIMENTS

Figure 1:
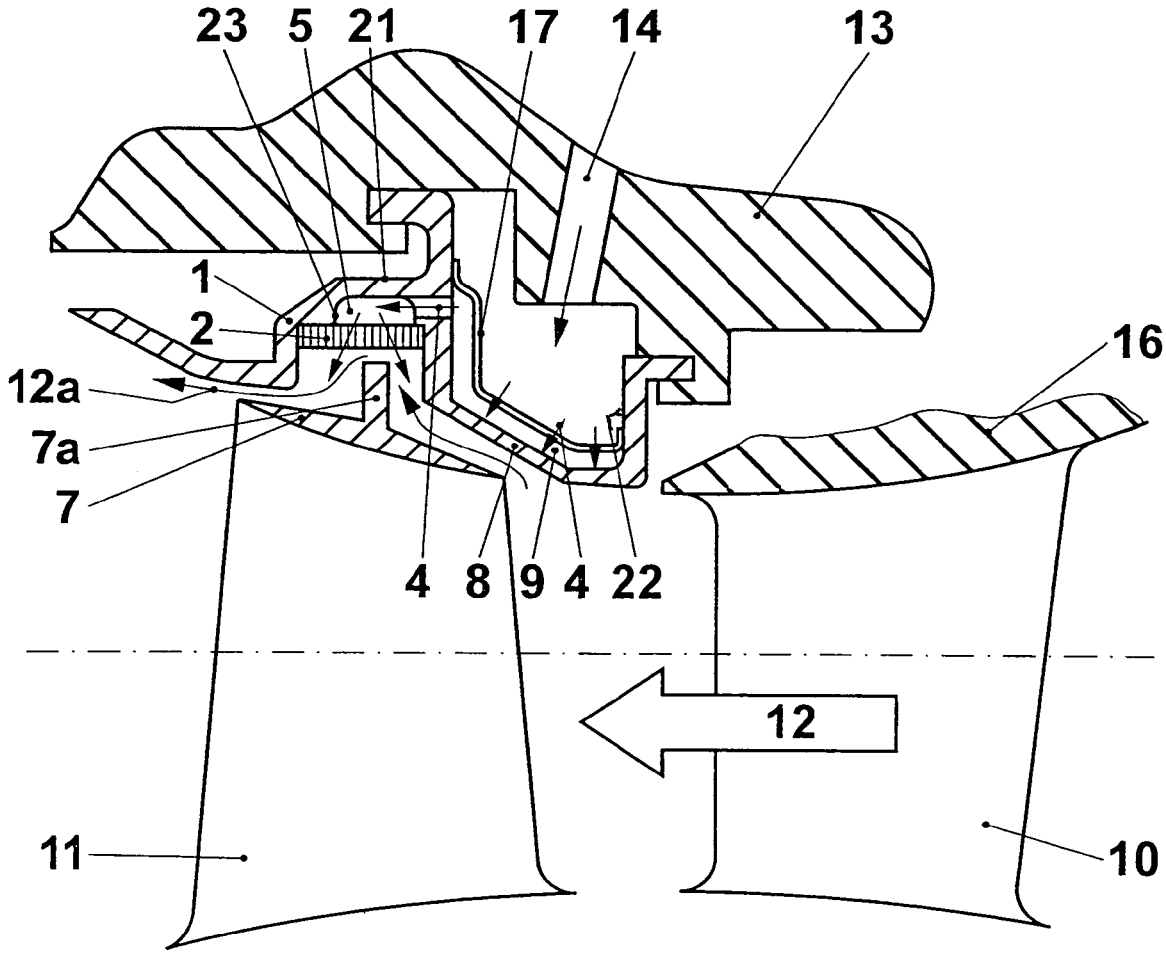
FIG. 1 shows an example of the implementation of the invention of the gas turbine.

FIG. 1 shows a detail of a flow duct of a turbomachine, for example of a turbine of the gas turbo set. The hot gas flow 12 flows through the flow duct from right to left. A guide vane foot 16 with a guide vane 10 is arranged in the stator 13 in a way that is not illustrated and is not relevant to the invention, but is familiar to the person skilled in the art. A moving blade 11 with a cover band 7 and with cover band tips 7*a* is arranged downstream of the guide vane 10. The cover band tips, in conjunction with suitable stator elements 2 arranged opposite them, minimize the leakage gap and consequently the hot gas leakage flow 12*a*. Some of the leakage gap can be kept small under nominal conditions, the opposite element 2 is normally a comparatively soft brushing-tolerant element. This is designed in the present instance as a transpiration-cooled gas-permeable honeycomb element. The outflow for the coolant flowing through to flow out into the leakage gap in cross current to the leakage stream is perfectly suitable for further reducing leakage flow. The element 2 is held in a carrier 1. The assembly according to the invention, fastened in the stator, comprises, furthermore, a gas-impermeable impact-cooled element 8, here a heat accumulation segment, that is arranged upstream of the gas-permeable element 2. Coolant, in particular cooling air or cooling vapor, is delivered via a supply line 14 in the casing 13. The coolant 4 is initially led at high velocity through orifices or nozzles of an impact-cooling element 17 and impinges with high momentum onto the cooling side of the element 8, the latter being cooled by impact cooling. After the impact cooling has been completed, the coolant 4 flows further on through the gas-permeable element 2 as transpiration coolant into the hot gas flow, in the present configuration the blade coverband 7 and the sealing tip 7*a* also being cooled. This coolant routing results in the best possible utilization of the coolant 4. As can be seen, a space or gap 5, 9 basically annular or in the form of a ring segment is formed between the gas-permeable element 2, the gas-impermeable element 8, an upstream wall 22, a downstream wall 23, the impact-cooling element 17 and a cover element 21. According to the invention, said space or gap is subdivided in the circumferential direction of the turbomachine, that is explained in more detail below particularly in conjunction with FIG. 3.

Figure 2:
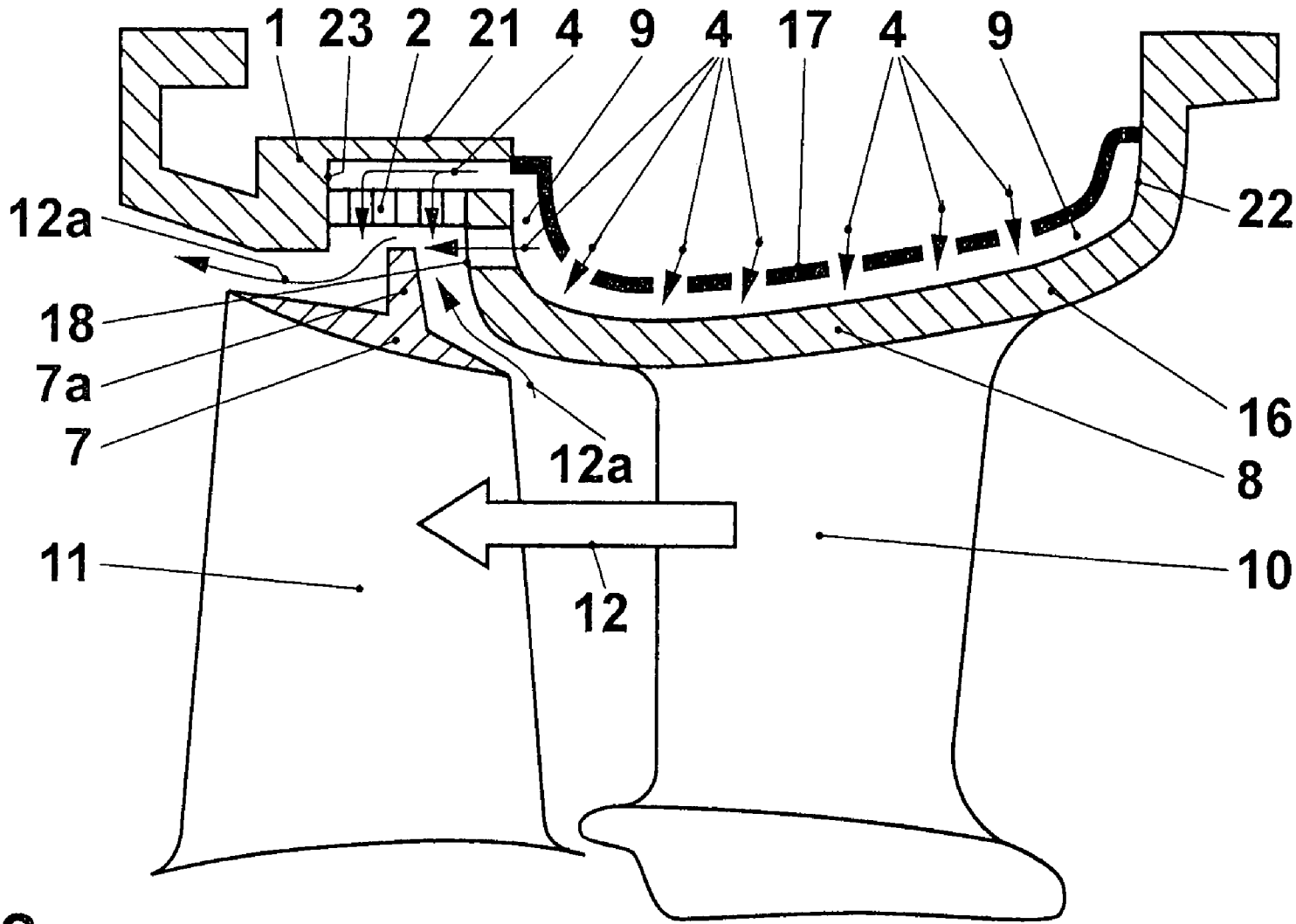
FIG. 2 shows an example of the implementation of the invention of an impact-cooled guide vane foot.

A further embodiment of the invention is illustrated in FIG. 2. Essential elements become clear automatically in light of the explanations relating to FIG. 1. In this exemplary embodiment, the gas-impermeable impact-cooled element 8 serves at the same time as a blade foot 16 of the guide vane 10. In a similar way to FIG. 1, a space 9, which is subdivided in the circumferential direction, which cannot be seen here, is formed between the gas-permeable element 2, the gas-impermeable element 8, the impact-cooling element 17, a cover element 21 and an upstream wall 22 and downstream wall 23. Coolant enters the space 9 through the impact-cooling element 17. Under undisturbed nominal conditions, the coolant 4 flows off at least predominantly through the gas-permeable element 2. Furthermore, the gas-impermeable element 8 has a further redundant coolant orifice 18, via which the coolant 4 can flow out of the space 9. This coolant orifice issues on the hot gas side of the assembly in such a way that coolant emerging there flows as a cooling film over the hot gas side of the gas-permeable element. In particular, the redundant coolant orifice 18 issues essentially tangentially to the hot gas side surface of the gas-permeable element 2. The redundant coolant orifice is preferably dimensioned such that, under undisturbed nominal conditions, less than half, in particular less than 30%, of the coolant mass flow 4 flows through the redundant coolant orifices 18. However, when the significant increase in the flow resistance of the gas-permeable element 2 occurs, for example due to contamination or a brushing event, the coolant flow is displaced into the redundant coolant orifices 18. Consequently, on the one hand, the flow for cooling the gas-impermeable element 8 is maintained, and, on the other hand, transpiration cooling which is absent on account of a decreasing throughflow is successively replaced by film cooling through the orifices 18.

Figure 3:
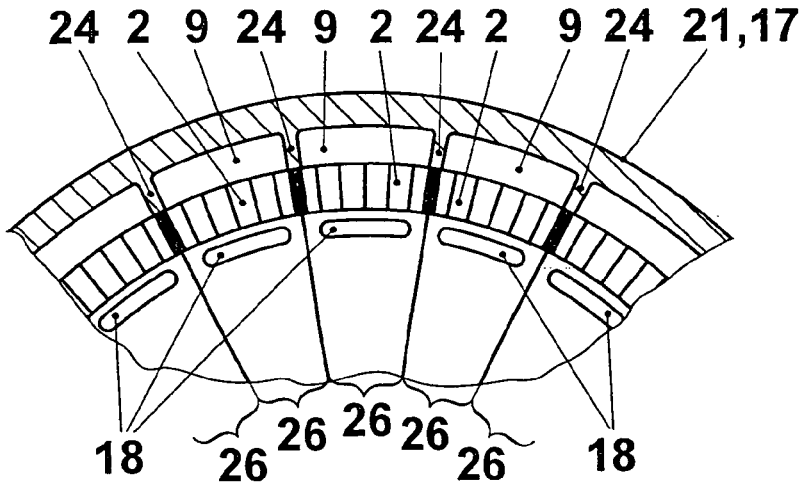
FIG. 3 shows a simplified partial cross-section of the assembly according to the invention.

FIG. 3 shows a diagrammatic view of a assembly according to the invention in a cross-sectional illustration. Essentially radially and axially running webs or subdividing walls 24 subdivide the space 9 in the circumferential direction into segments 26. A specific redundant coolant orifice 18 also is arranged for each segment 26; at least the issue of said coolant orifices is in the form of a long hole, in order, if required, to achieve a distribution of film coolant over as large an area as possible. Consequently, the overall coolant path is subdivided, at least downstream of the impact-cooling element 17 into segments fully independent of one another by means of the subdivided walls 24. Furthermore, an individual gas-permeable element 2 also is arranged for each segment 26. If, then, a pronounced brushing of a blade tip 7*a*, not illustrated here, occurs in a segment, see FIG. 1 or 2 in this respect, only the directly affected gas-permeable element is torn out of the assembly. On account of the mechanical decoupling of the gas-permeable elements 2 of the various segments 26, the mechanical damage event remains restricted to the directly affected segments. Of course, the coolant pressure collapses in the space 9 of the affected segment. However, since the segments are separated from one another and the critical pressure loss occurs in the impact-cooling elements 17, the coolant pressure in the other segments remains constant at least in a good approximation, and the damage event is completely restricted locally to the affected segment or segments. The impact cooling of the gas-impermeable element in the affected segment also remains essentially unrestrictedly operational.

Figure 4:
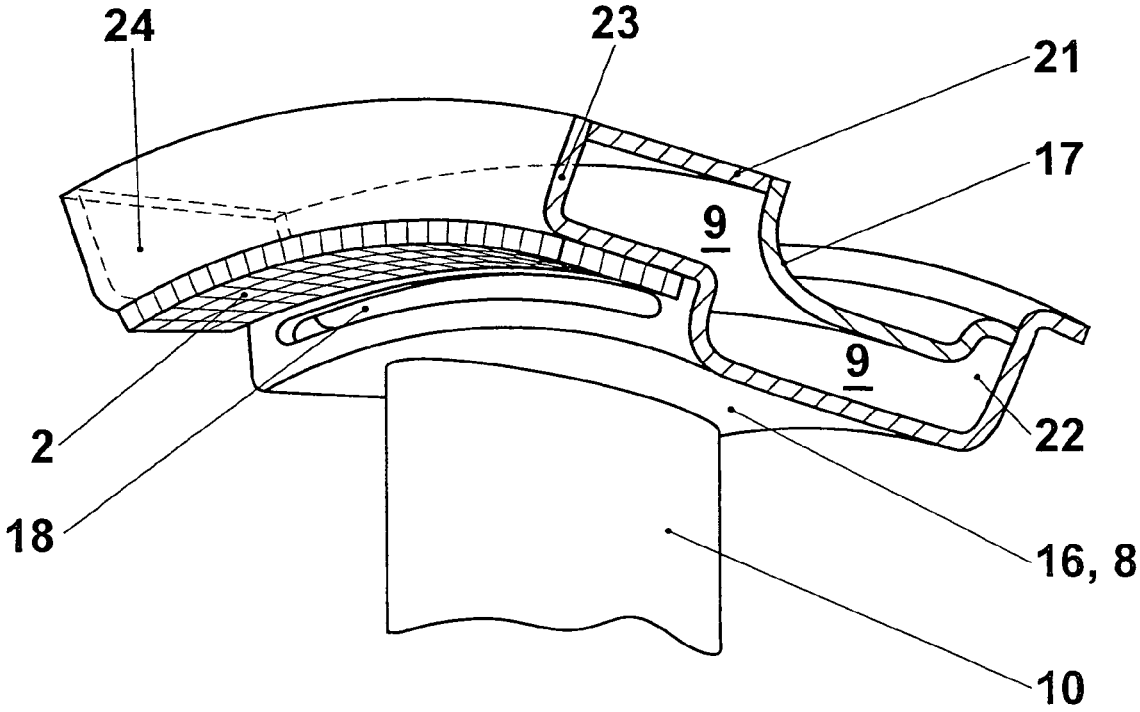
FIG. 4 shows a subassembly for constructing an assembly according to the invention in a turbomachine, in particular a gas turbo set.

In an actual implemented turbomachine, the assembly according to the invention is advantageously constructed from a plurality of subassemblies arranged next to one another in a circumferential direction, thus appreciably simplifying the handling of the invention. Such a subassembly is illustrated by way of example in a perspective view in FIG. 4. This is a subassembly of the assembly from FIG. 2 and comprises a circumferential segment with a guide vane 10, together with the impact-cooled blade foot 16 of the latter. The subassembly comprises, furthermore, the gas-permeable element 2, an impact-cooling element 17, a cover element 21 and an upstream wall 22 and downstream wall 23. By virtue of the arrangement illustrated, a gap 9 in the form of a ring segment is formed, which is closed in the radial and axial direction and is open per se on the circumferential side of the subassembly. According to the invention, the subassembly comprises a subdividing wall 24 that may be arranged on a circumferential side of the subassembly or in another circumferential position. The subdividing wall is designed in such a way that, as explained in connection with FIG. 3, it provides fluid separation between the two circumferential sides.

Figure 5:
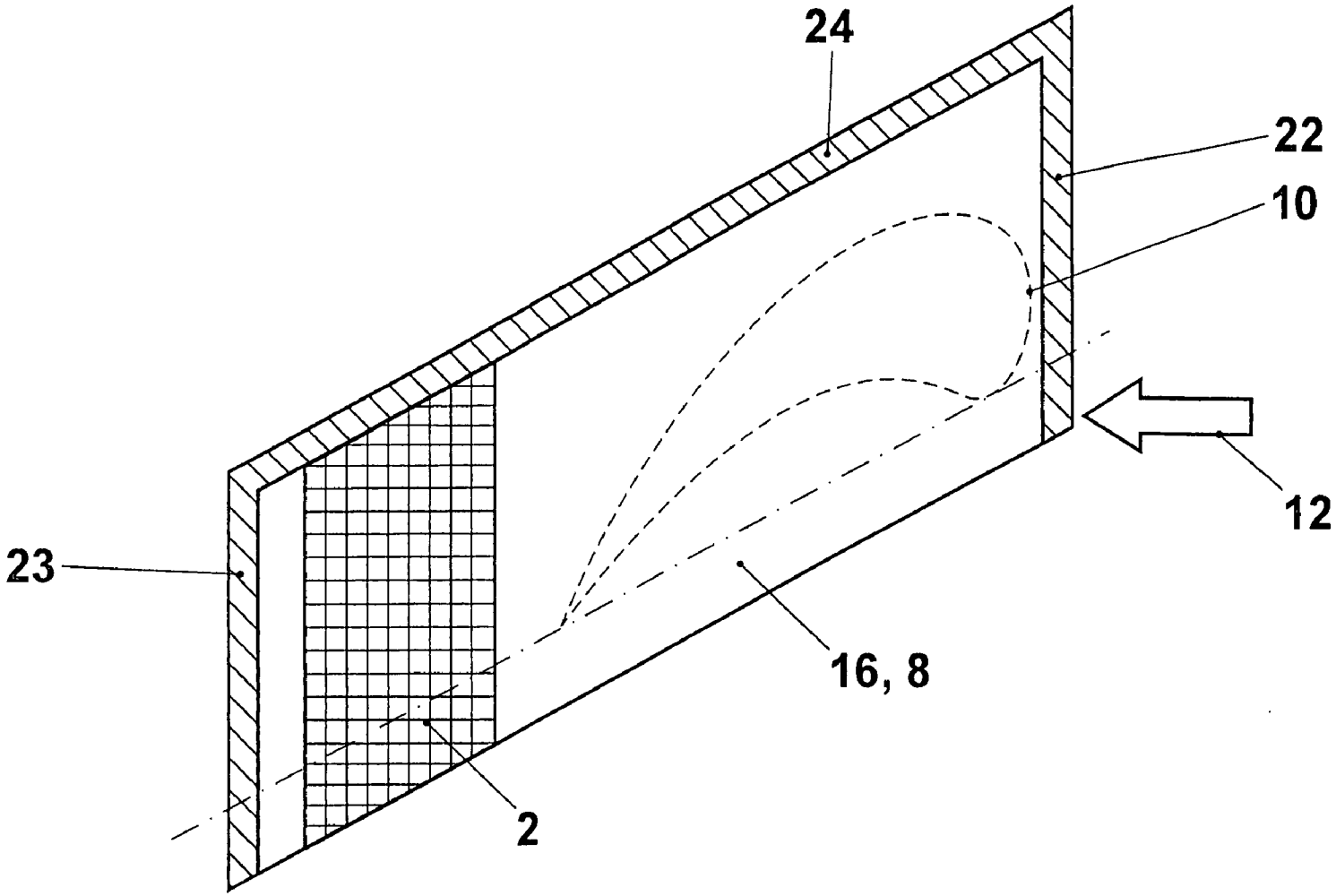
FIG. 5 shows a simplified top view of the subassembly.

Finally, FIG. 5 shows a diagrammatic top view of the subassembly radially from outside, with "opened-up" walls 22, 23, 24. It can be seen that, in this preferred embodiment, the space 9, not explicitly identified in FIG. 5, but clearly recognizable by a person skilled in the art in light of the statements given above, is subdivided in the circumferential direction by a subdividing wall 24 that runs parallel to the profile chord, depicted by dashes and dots, of the blade 10. The subdividing wall 24 is in this case arranged directly on a circumferential side of the subassembly; it could, however, also be arranged readily in another circumferential position.

Statements made here on annular geometries or geometries in the form of a ring segment can readily be transferred by a relevant person skilled in the art to plane geometries, in which case lateral segments are arranged next to one another instead of circumferential segments.

LIST OF REFERENCE NUMERALS

1 Carrier element
2 Gas-permeable element
4 Coolant
5 Space, gap
7 Blade coverband
7*a* Sealing tip
8 Gas-impermeable element
9 Coolant duct, gap
10 Guide vane
11 Moving blade
12 Hot gas flow
12*a* Leakage flow
13 Casing wall, stator
14 Supply line for coolant
16 Blade foot
17 Impact-cooling element, impact-cooling plate, impact-cooling insert
18 Redundant coolant orifice
21 Cover element
22 Upstream delimitation, wall
23 Downstream delimitation, wall
24 Subdividing wall, circumferential or lateral subdividing wall
26 Segment

What is claimed is:

1. A hot gas pat assembly for a turbomachine, the hot gas path assembly comprising:

an operation hot gas flow direction;

a cross-section selected from the group consisting of annular and annulus-section shaped;

a cooling side and a hot gas side, with hot gas flowing over a surface of the hot gas side in the operation hot gas flow direction during operation;

at least one gas-permeable element configured and adapted for transpiration cooling and at least one gas-impermeable element, the gas-permeable element and the gas-impermeable element being arranged in different positions on a wall of a hot gas path in the operation hot gas flow direction;

the gas-impermeable element being configured and adapted for impingement cooling, with an impingement cooling element being arranged on the cooling side at a distance from te gas-impermeable element, a coolant path being formed on the cooling side of the assembly, and with the coolant path leading from the impingement cooling element to a coolant side of the gas-permeable element;

at least one dividing wall configured and adapted for subdividing the coolant path into a multitude of fluidly isolated segments in a circumferential direction; and an airfoil arranged on the gas-impermeable element;

wherein the at least one dividing wall for subdividing the coolant path is arranged essentially parallel to profile chords of the airfoil.

2. The assembly of claim 1, wherein a plurality of individual gas-permeable elements are arranged next to one another in the circumferential direction.

3. The assembly of claim 2, wherein at least one individual gas-permeable element is ranged for each segment.

4. The assembly of claim 1, wherein the gas-permeable element is configured and adapted as a part of a non-contact sealing arrangement in the hot gas path.

5. The assembly of claim 1, wherein the gas-impermeable element is arranged upstream of the gas-permeable element in the operation hot gas flow direction.

6. The assembly of claim 1, further comprising a coolant outlet arranged in the gas-impermeable element and connecting the hot gas side and the coolant side, the coolant outlet opening on the hot gas side upstream of the gas-permeable element in the operation hot gas flow direction.

7. A hot gas path assembly for a turbomachine, the hot gas path assembly comprising:

an operation hot gas flow direction;

a cross-section selected from the group consisting of annular and annulus-section shaped;

a cooling side and a hot gas side, with hot gas flowing over a surface of the hot gas side in the operation hot gas flow direction during operation;

at least one gas-permeable element configured and adapted for transpiration cooling and at least one gas-impermeable element, the gas-permeable element and the gas-impermeable element being arranged in different positions on a wall of a hot gas path in the operation hot gas flow direction;

the gas-impermeable element being configured and adapted for impingement cooling, with an impingement cooling element being arranged on the cooling side at a distance from the gas-impermeable element, coolant path being formed on the cooling side of the assembly, and with the coolant path leading from the impingement cooling element to a coolant side of the gas-permeable element; and at least one dividing wall configured and adapted for subdividing the coolant path into a multitude of fluidly isolated segments in a circumferential direction;

wherein the assembly comprises a plurality of subassemblies arranged next to one another in the circumferential direction.

8. The assembly of claim 7, further comprising an airfoil arranged on the gas-impermeable element.

9. The assembly of claim 8, wherein the at least one dividing wall for subdividing the coolant path is arranged essentially parallel to profile chords of the airfoil.

10. A turbomachine comprising a hot gas path assembly, wherein the hot gas assembly comprises;

an operation hot gas flow direction;

a cross-section selected from the group consisting of annular and annulus-section shaped;

a cooling side and a hot gas side, with hot gas flowing over a surface of the hot gas side in the operation hot gas flow direction during operation;

at least one gas-permeable element configured and adapted for transpiration cooling and at least one gas-impermeable element, the gas-permeable element and the gas-impermeable element being arranged in different positions on a wall of a hot gas path in the operation hot gas flow direction;

the gas-impermeable element being configured and adapted for impingement cooling, with an impingement cooling element being arranged on the cooling side at a distance from the gas-impermeable element, a coolant path being formed on the cooling side of the assembly, and with the coolant path leading from the impingement cooling element to a coolant side of the gas-permeable element;

at least one dividing wall configured and adapted for subdividing the coolant path into a multitude of fluidly isolated segments in a circumferential direction; and an airfoil arranged on the gas-impermeable element;

wherein the at least one gas-permeable element forms a peripheral ring for non-contact sealing relative to a blade ring arranged opposite thereto; and wherein the at least one dividing wall is arranged essentially parallel to profile chords of the airfoil.

11. The turbomachine of claim 10, wherein the at least one gas-impermeable element forms a peripheral ring that is arranged upstream of the at least one gas-permeable element in the operation hot gas flow direction.

12. The turbomachine of claim 10, wherein the at least one gas-impermeable element comprises impact-cooled heatshield segments.

13. The turbormachine of claim 10, further comprising airfoils arranged on the gas-impermeable elements.

14. The turbomachine of claim 10, wherein the assembly is arranged in a stator of the turbomachine.

15. The turbomachine of claim 10, wherein the turbomachine is a gas turbine.

16. A turbomachine comprising a hot gas path assembly, wherein the hot gas assembly comprises:

an operation hot gas flow direction;

a cross-section selected from the group consisting of annular and annulus-section shaped;

a cooling side and a hot gas side, with hot gas flowing over a surface of the hot gas side in the operation hot gas flow direction during operation;

at least one gas-permeable element configured and adapted for transpiration cooling and at least one gas-impermeable element, the gas-permeable element and the gas-impermeable element being arranged in different positions on a wall of a hot gas path in the operation hot gas flow direction;

the gas-impermeable element being configured and adapted for impingement cooling, with an impingement cooling element being arranged on the cooling side at a distance from the gas-impermeable element, a coolant path being formed on the cooling side of the assembly, and with the coolant path leading from the impingement cooling element to a coolant side of the gas-permeable element; and at least one dividing wail configured and adapted for subdividing the coolant path into a multitude of fluidly isolated segments in a circumferential direction;

wherein the at least one gas-permeable element forms a peripheral ring for non-contact sealing relative to a blade ring arranged opposite thereto; and wherein the assembly comprises a plurality of subassemiblies arranged next to one another in the circumferential direction.

17. A hot gas path assembly for a turbomachine, the hot gas path assembly comprising:

a plurality of subassemblies, each of the subassemblies comprising a gas-impermeable element configured and adapted for transpiration cooling, a gas-impermeable element configured and adapted for impingement cooling, an impingement cooling element arranged on a cooling side at a distance from the gas-impermeable element, and an airfoil arranged on the gas-impermeable element, with the gas-impermeable element and the gas-impermeable element being arranged in different positions on a wall of a hot gas path in an operation hot gas flow direction, and with a coolant path segment leading from the impingement cooling element to a coolant side of the gas-permeable element;

at least one dividing wall configured and adapted to prevent fluid communication between cooling path segments of adjacent subassemiblies in a circumferential direction;

wherein the at least one dividing wall is arranged essentially parallel to profile chords of the airfoil.

18. The hot gas path assembly of claim 17, wherein the gas-impermeable element is a blade foot.

19. The hot gas path assembly of claim 17, wherein each subassembly further comprises a redundant coolant orifice.

20. The hot gas path assembly of claim 17, wherein the redundant coolant orifice communicates with space between the gas-permeable element and the gas-impermeable element.

* * * * *

UNITED STATES PATENT AND TRADEMARK OFFICE

CERTIFICATE OF CORRECTION

PATENT NO. : 7,104,751 B2
APPLICATION NO. : 10/865749
DATED : September 12, 2006
INVENTOR(S) : Naik et al.

It is certified that error appears in the above-identified patent and that said Letters Patent is hereby corrected as shown below:

In claim 1, Col, 7, line 63, replace “pat” with --path--, and in Col. 8, line 13, replace “te” with --the--.

In claim 3, Col. 8, line 30, replace “ranged” with --arranged--.

In claim 7, Col. 8, line 60, replace “coolant” with --a coolant--.

In claim 16, Col. 10, line 18, replace “wail” with --wall--, and in Col. 10, lines 24-25, replace “subassemi-blies” with --subassemblies--.

In claim 17, Col. 10, line 30, replace “gas-impermeable” with --gas-permeable--, in Col. 10, line 36, replace “with the gas-impermeable” with --with the gas-permeable--, and in Col. 10, line 44, replace “subassemiblies” with --subassemblies--.

Signed and Sealed this

Fourteenth Day of August, 2007

JON W. DUDAS
*Director of the United States Patent and Trademark Office*